United States Patent [19]

Hirakata et al.

[11] Patent Number: 4,687,565

[45] Date of Patent: Aug. 18, 1987

[54] ELECTROLYTIC CELL FOR PRODUCING PERIODATES

[75] Inventors: Kaoru Hirakata, Yoshioka; Masaaki Mochizuki, Shibukawa; Hideo Kanai; Reiichi Itai, both of Maebashi, all of Japan

[73] Assignee: The Japan Carlit Co., Ltd., Tokyo, Japan

[21] Appl. No.: 843,981

[22] Filed: Mar. 25, 1986

[30] Foreign Application Priority Data

Mar. 27, 1985 [JP] Japan ..... 60-60983

[51] Int. Cl.[4] ..... C25B 9/00; C25B 11/02; C25B 1/28

[52] U.S. Cl. ..... 204/258; 204/265; 204/266; 204/82

[58] Field of Search ..... 204/256, 258, 266, 82, 204/296

[56] References Cited

U.S. PATENT DOCUMENTS

| | | | |
|---|---|---|---|
| 1,548,362 | 8/1925 | Holmboe | 204/258 |
| 1,942,208 | 1/1934 | Gamichon | 204/256 X |
| 2,830,941 | 4/1958 | Mehltretter | 204/82 |
| 3,131,137 | 4/1964 | Lancaster et al. | 204/82 |

FOREIGN PATENT DOCUMENTS

| | | | |
|---|---|---|---|
| 699212 | 12/1964 | Canada | 204/82 |
| 0194280 | 11/1982 | Japan | 204/82 |

*Primary Examiner*—Donald R. Valentine

*Attorney, Agent, or Firm*—Frishauf, Holtz, Goodman & Woodward

[57] ABSTRACT

An improved electrolytic cell of simple construction capable of satisfactorily producing periodates comprises a plurality of cathodes mounted vertically in parallel to the long sides of a cell body and spaced at equal intervals from each other, a plurality of open anodic compartment boxes with plate separators adapted to maintain the equal intervals, one or more anodes inserted in the compartment boxes, a plurality of PVC diaphragms mounted on both sides of the anodic compartment boxes in parallel to the cathodes, an anolyte inlet mounted in the lower part of the anodic compartment boxes and an anolyte outlet mounted in the upper part of the opposite side of the anodic compartment boxes, a cell cover provided with air intake holes and cell gas exhaust pipes, and perforated PVC lids for the cathodic compartments positioned between the cell cover and the upper level of the catholyte.

6 Claims, 4 Drawing Figures

ELECTROLYTIC CELL FOR PRODUCING PERIODATES

BACKGROUND OF THE INVENTION

1. Field of the Invention

This invention relates to an electrolytic cell for producing periodates used as oxidizing agents for organic synthesis.

2. Prior Art

Periodates are usually produced by an electrochemical process, not by a chemical process. The electrolytic cell comprises lead dioxide anodes and mild steel cathodes. In practising this method, an acidic iodate solution is circulated in the anodic compartments and sodium hydroxide (or sulfuric acid) solution is added into the cathodic compartments, and thus iodates are electrolytically oxidized to periodates by using the electrolytic cell provided with diaphragms.

In general, porous porcelain and/or ceramic diaphragms are used for electrolysis but these diaphragms are consumed extensively by the strong oxidizing and alkaline solution. High consumption of diaphragms leads to generation of residues, contamination of both electrolytes, and clogging of the electrolyte flow, and hence anode consumption creates such problems as degradation of the anodes and reduction in current efficiency. For that reason, replacement of anodes and diaphragms and cleaning of the electrolytic cell has to be done every 2 to 4 months. Even if expensive diaphragms are used they will be consumed completely within about six months and will need to be replaced with new ones. In addition, as the diaphragms are fragile and possess insufficient resistance to tightening pressure, they need to be reassembled carefully. Also, in the case of applying cation exchange membranes (Japanese Public Disclosure No. 23286/81), the hydrocarbon membrane has insufficient durability, while on the other hand the fluorocarbon membrane is very expensive. Moreover, maintenance of the membrane is troublesome because of the need to perform conditioning and maintain the wettability of the membrane so as to avoid its shrinkage. The cell cover is provided with the air intake holes and cell gas exhaust pipes. The gas generated by electrolysis consists of hydrogen and a small amount of oxygen, and it is discharged to the outside of the cell through exhaust pipes with a large amount of air for safety reasons. In this process, alkali carbonate crystals accompanied by alkali mist clog the exhaust pipes, thus obstructing the outward flow of gas, causing air pollution in the room in which the cell is located, and also increasing the possibility of hydrogen gas exploding in the cell. When the gap between the level of the solution and the cell cover is kept below 100 millimeters, a large amount of mist accompanies the cell gas as it flows into the exhaust pipes and hence the exhaust pipes require cleaning every 2 or 3 days.

SUMMARY OF THE INVENTION

It is therefore an object of the present invention to provide an electrolytic cell for producing periodates while reducing the residues formed by consumption of diaphragms, thereby decreasing anode consumption and improving current efficiency.

Another object of the present invention is to provide an electrolytic cell for producing periodates wherein the necessary term for recoating or replacing anodes and cleaning or replacing the diaphragms is prolonged to more than one year, and wherein the cell gas is exhausted smoothly and safely, and the cleaning term is prolonged to once every 2 to 3 weeks.

Other objects and advantages of the present invention may become apparent to those skilled in the art from the following description and disclosure.

This invention relates to an electrolytic cell for producing periodates comprising a plurality of cathodes mounted vertically in parallel to the long sides of the cell body and spaced at equal intervals from each other, a plurality of open anodic compartment boxes with plate separators adapted to maintain equal intervals between the cathodes, one or more anodes inserted in the anodic compartment boxes, a plurality of diaphragms of polyvinyl chloride (hereafter referred to as PVC) mounted on both sides of the anodic compartment boxes in parallel to the cathodes, anolyte inlets mounted at the lower part of the anodic compartment boxes, anolyte outlets at the upper part of the opposite side of said boxes, a cell cover with air intake holes and cell gas exhaust pipes mounted on the cell body, and perforated PVC lids for the cathodic compartments positioned between the cell cover and the upper level of the catholyte.

BRIEF DESCRIPTION OF THE DRAWINGS

The drawings illustrate embodiments of the invention.

DETAILED DESCRIPTION

Figure 1:
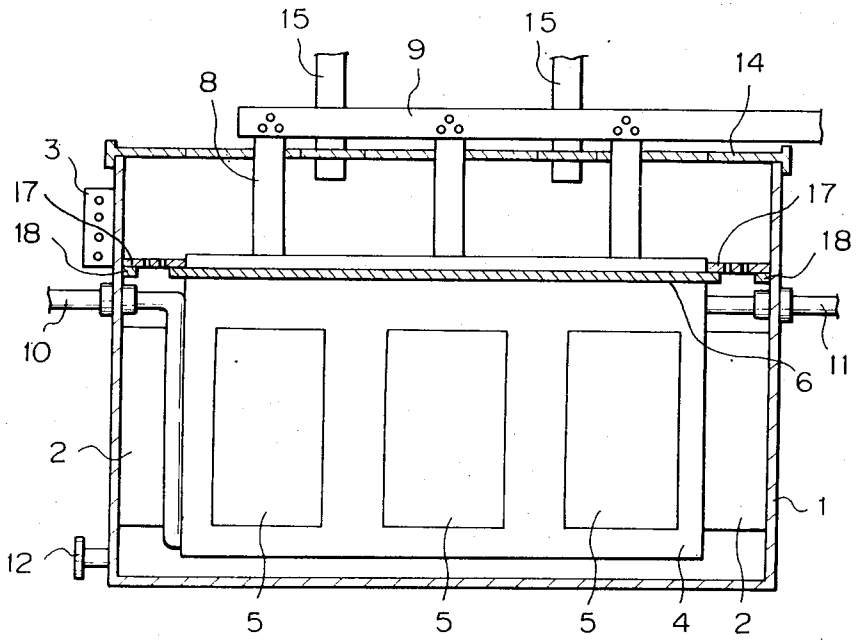
FIG. 1 and FIG. 2 respectively show longitudianl cross-sectional views taken on the lines A—A′ and B—B′ indicated in FIG. 3.
Figure 2:
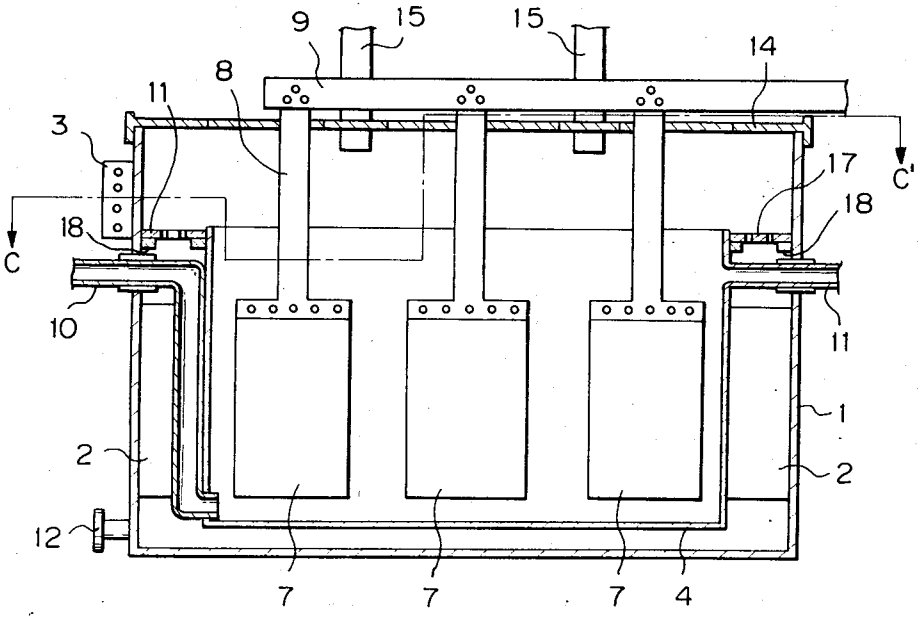

Referring now to the drawings in FIGS. 1–4, a plurality of cathodes of mild steel 2 are arranged vertically in parallel to the side of the cell body spaced at equal intervals in the box-like cell body of mild steel or alloyed steel, and both ends of the cathodes are welded to the cell body. The distance between the lower end of the cathodes and the bottom of the cell body 1 should be kept constant and the cathodes should be below the upper level of the catholyte. The cathodic terminal 3 is welded on the outside of the cell body 1.

Figure 4:
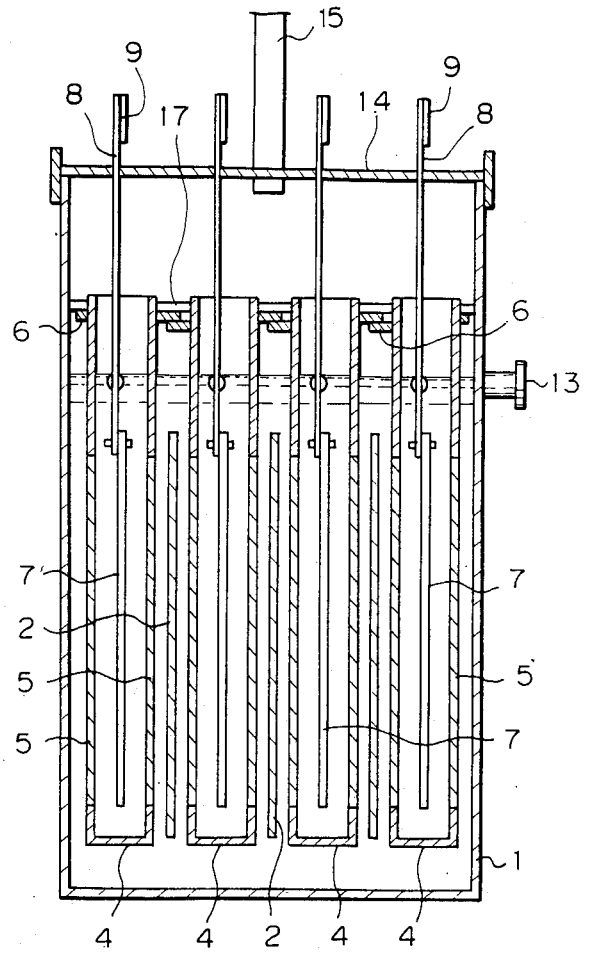
FIG. 4 shows a longitudinal cross-sectional view taken on the line D—D′ indicated in FIG. 3.

A plurality of open anodic compartment boxes 4 made of rigid PVC are respectively mounted in the cell body 1 in the center of each space defined by cathodes 2 and are kept above the bottom of the cell body 1. A plurality of diaphragms 5 made of rigid PVC are mounted like windows on both sides of the anodic compartment box 4 in parallel to the cathodes 2. Synthetic resins such as polyethylene, polypropylene, teflon, etc. can be used as the constituent materials of the diaphragms 5. The plate separators 6 are mounted around the upper part of each anodic compartment box 4 and keep a certain space around each of the anodic compartment boxes as well as serving as a lid which prevents alkaline mist escaping from the catholyte. Each plate separator 6 is offset from the adjacent one so that they overlap each other as shown in FIG. 4. One or more anodes 7 are inserted in the anodic compartment box. Two types of lead dioxide electrodes are used as the anodes 7, one being made by anodic oxidation of a lead substrate surface area such as to form lead dioxide, and the other one being made by electroplating lead dioxide on a titanium substrate. Each anode 7 is connected with the outside busbar 9 through the titanium lead 8 which is noncorrosive with respect to the electrolyte. The anolyte inlet 10 is disposed in the lower part of the anodic compartment box, while on the other hand the anolyte outlet 11 is disposed in the upper part of the opposite side of the box. The anolyte is kept at a constant level and flows diagonally from the lower position to the upper position. In the process, the anolyte is circulated between the anodic compartment boxes and an outside tank (not shown) of anolyte. The catholyte is charged through the catholyte inlet 12 at the lower end of the cell body 1, and is discharged from the catholyte outlet 13 at the upper part of the cell body 1. The catholyte is circulated between a tank (not shown) of catholyte and the catholyte compartments. The anolyte and catholyte are kept at nearly the same levels.

Figure 3:
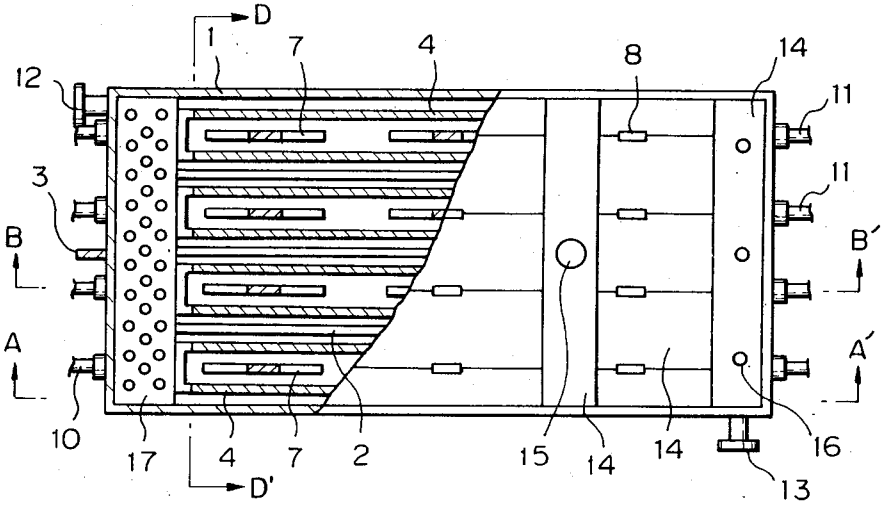
FIG. 3 shows a partially cut away cross-sectional plan view taken on the line C—C′ indicated in FIG. 2.

The cell cover 14 made of three sizes of PVC plates is mounted on the cell body 1. This cell cover 14 is made of three types of PVC plates which can be easily assembled. For example, as shown in FIG. 3, the PVC plates can be classified as three components, which are to be respectively mounted for the portion of titanium lead 8, for the cell gas exhaust pipe 15, and for the air intake hole 16. The perforated PVC lids 17 of the cathodic compartments are positioned between the cell cover and the upper level of the catholyte, being mounted on the plate separators 6 and the supporter 18. The preferred distance between the upper level of the catholyte and the perforated PVC lid of the cathodic compartment is about 100 mm.

The hydrogen gas generated electrolytically from the cathodes is dispersed and held under the plate separators 6 of the anodic compartment boxes 4, moves to the perforated PVC lids 17, and then can be discharged to the outside of the cell through the exhaust pipe 15. In this process, most of the alkaline mists accompanying the cell gas are removed and refluxed. The perforated PVC lids 17 which serve as a demister can be replaced by materials such as wire net, expanded metal, punched plate, and so on. The hydrogen gas (containing a small part of the oxygen) generated from the cathodic compartment is diluted so as to be kept below the explosion limit with the air from the air intake holes 16 of the cell cover and is discharged to the outside of the cell through the exhaust pipe 15.

The electrolytic cell for producing periodates of this invention is concerned with reducing the residues formed by the consumption of diaphragms, decreasing anode consumption and improving current efficiency by employing the noncorrosive diaphragms of synthetic resins such as PVC. It was confirmed that the necessary term for recoating or replacing anodes and for cleaning or replacing the diaphragms was prolonged to more than one year. In the case of the prior art cell, the ceramic diaphragm was mounted by employing a fixing frame of PVC and synthetic resin sealant. However, with the cell of this invention, the diaphragm of PVC can be directly welded to the anode compartment box and hence the electrode gap is reduced by half compared with the prior art cell and the cell voltage is decreased. Furthermore, as a result of superior treatment of the generating hydrogen gas and decreasing the accompanying alkaline mist by mounting a lid on the cathodic compartment and providing the spacers for the anodic compartment, the cell gas is exhausted smoothly and safely, and the cleaning term is thereby prolonged to once every 2 to 3 weeks.

This invention is now described in greater detail by reference to the following examples which are given here for illustrative purposes only and are by no means intended to limit the scope of the invention.

EXAMPLE 1

Three cathodes were welded to a cell body of mild steel in 8 mm thickness with a size of 1,500 mm (length)×400 mm (width)×900 mm (height) in outer dimensions. Four anodic compartment boxes were mounted in the cell and six diaphragms of PVC were mounted like windows on the both sides of the box, three diaphragms on each side, and the boxes were carefully placed in the center of the spaces defined by the cathodes. The anodes were made by anodic oxidation of lead substrates for 3 hours at 3 A/dm$^2$ in 10% sulfuric acid. Three anodes as large as 25 dm$^2$ in area were respectively fixed to the copper bus bar by connecting the titanium lead plates of the anodes and were each set in an anodic compartment box. The gap between electrodes was about 50 mm. The lid of the cathodic compartment was a perforated PVC plate with holes 3 mm (diameter)×20 mm (pitch) punched thereon. The air intake hole of the cell cover had a 20 mm diameter, and the exhaust pipe was made of rigid PVC pipe with a 40 mm inside diameter.

A long run test of sodium periodate production was performed by a batch process using this electrolytic cell. An anolyte containing iodate (0.55 mole/l) in a volume of 3 m$^3$ was stored in the recycling tank and a sodium hydroxide solution (2 mole/l) in a volume of 2 m$^3$ was stored in the other recycling tank as the catholyte. The anolyte and the catholyte were caused to circulate by the attached pump at the rate of 30–40 l/min, respectively. The anolyte was controlled such as to be distributed equally in the anodic compartment by adjusting the attached valve. The anolyte was electrolyzed for the desired concentration of sodium periodate (0.5 mole/l as periodate acid) under the following conditions; cell temperature of 40°–50° C., current at 700 A and duration of test run: 140 hours. The major part of the anolyte was transferred to the other tank under the power of the attached pump, and then fresh sodium iodate solution was recharged and the test run was continued.

A portion of the catholyte was removed from the cathodic compartments every 20 days, and pure water was added to keep the alkalinity of the catholyte constant. Every time the cell was tested, at intervals of about 10 months, the current efficiency was found to be 85–90% with a conversion rate of iodate to periodate of about 85%. During the test run of the cell, no intermixture of sediments in the anolyte or catholyte was seen, nor were any defects in the PVC diaphragms found. Therefore, it was safe enough to clean the exhaust pipes every 15 to 20 days.

COMPARATIVE EXAMPLE 1

Table 1 shows comparative data for Example 1 and the prior art electrolysis which was performed by using the boxlike cell provided with porcelain diaphragms under the same conditions as used in Example 1.

TABLE 1

| | The cell of this invention | The cell of prior technology |
|---|---|---|
| electrodes gap (mm) | 50 | 100 |
| cell voltage (V) | 4.7 | 5.3 |
| current efficiency (%) | 85–90 | 75–80 |
| frequency of exchaning diaphragms (months) | >10 | 4 |
| life of anode (months) | >10 | 4 |
| frequency of cleaning exhaust pipe (days) | 15–20 | 2–3 |
| sediments in anode | small (after 6 months) | large (after 1 month) |
| sediments in cathode | small (after 6 months) | large (after 1 month) |

The sediments in the electrodes were checked visually by stopping electrolysis for a short time.

What is claimed is:

1. In an electrolytic cell having diaphragms, in which an anolyte of an acidic iodate solution is circulated in anode compartments and a catholyte selected from the group consisting of an alkali hydroxide solution and an inorganic acid is added into cathodic compartments, and in which iodates are electrolytically oxidized to periodates, the improvement wherein said electrolytic cell comprises:

a cell body having substantially parallel long sides and opposite ends;

a plurality of cathodes mounted vertically in parallel to said long sides of said cell body and spaced at substantially equal intervals from each other;

a plurality of spaced apart open anodic box-like compartments mounted in said cell body between adjacent cathodes;

a plurality of cathodic compartments in said cell body, said cathodic compartments each comprising a space between two respective spaced apart anodic compartments, each cathodic compartment having at least one of said cathodes therein;

a plurality of plate separators arranged between adjacent anodic compartments to maintain the spacing between adjacent anodic compartments, each of said plate separators being offset from an adjacent plate separator so that said plate separators overlap each other to hold hydrogen cell gas generated from said cathodes to permit such hydrogen cell gas to travel to said ends of said cell body under said plate separators to permit removal of said hydrogen cell gas at said ends of said cell body and to prevent alkaline mist from escaping from the catholyte;

at least one polyvinyl chloride diaphragm mounted on each opposite side of each of said anodic compartments;

an anolyte inlet coupled to a lower part of said anodic compartments for supplying an anolyte to said anodic compartments, and an anolyte outlet coupled to an upper part of the opposite sides of the respective anodic compartments;

a catholyte inlet coupled to a lower end of said cell body for supplying a catholyte to said cell body, and a catholyte outlet coupled to an upper part of said cell body;

a cell cover provided with both air intake holes and cell gas exhaust pipes for exhausting cell gas generated from said cathodes; and perforated plate-like lids at both opposite ends of said cell body, said perforated lids being mounted between said cell cover and the upper level of said catholyte for receiving said hydrogen cell gas from said plate separators under said perforated lids, whereby most of alkaline mists accompanying said hydrogen cell gas are removed and refluxed by said perforated lids.

2. The electrolytic cell of claim 1, wherein said cathodes are plate-like cathode members.

3. The electrolytic cell of claim 2, wherein said anodic compartments extend downwardly in said cell body to a position lower than the lower edge of said plate-like cathodes.

4. The electrolytic cell of claim 1, wherein each of said anodic compartments contains an anode mounted therein and which is out of electrical contact with the walls of said anodic compartment.

5. The electrolytic cell of claim 4, wherein said anodes are plate-like anodes.

6. The electrolytic cell of claim 2, wherein each opposite side of said anodic compartments have a plurality of said diaphragms mounted thereon.

* * * * *